United States Patent [19]

Batmanghlich

[11] Patent Number: 4,585,231

[45] Date of Patent: Apr. 29, 1986

[54] METHOD OF FORMING A DEVICE FOR VIEWING COMPOSITE DESIGNS

[76] Inventor: Ebrahim Batmanghlich, 1155 N. La Cienaga Blvd., #304, Los Angeles, Calif. 90069

[21] Appl. No.: 460,456

[22] Filed: Jan. 24, 1983

[51] Int. Cl.[4] ..... A63F 9/08

[52] U.S. Cl. ..... 273/155; 434/160; 434/404

[58] Field of Search ..... 273/155, 157 A; 434/404, 160

[56] References Cited

U.S. PATENT DOCUMENTS

| | | | |
|---|---|---|---|
| 2,543,998 | 3/1951 | Shulman | 273/155 UX |
| 3,608,206 | 9/1971 | Knott | 273/155 X |
| 3,995,862 | 12/1976 | Bertin | 273/155 X |

FOREIGN PATENT DOCUMENTS

| | | | |
|---|---|---|---|
| 12693 | of 1897 | United Kingdom | 273/155 |

*Primary Examiner*—Anton O. Oechsle
*Attorney, Agent, or Firm*—Herzig & Yanny

[57] ABSTRACT

A play device or game in the form of circular top and bottom members having a group of individual transparent disks between the members, the top member having a cutout or window through which a section of all disks can be seen. The disks carry a group or pattern of opaque spots on their surfaces so arranged that the disks can be positioned to provide alignments of groups of spots on individual disks observable through the window so that the spots collectively define the outline of a letter, geometric figure, or other design. Methodology is provided by way of use of rectangular grids, each having spots arranged to represent a component of a letter or figure. The grids are identified by a number, and then tabulated to indicate the grid components that make up each letter or figure and are then used for positioning the opaque spots in the disks.

2 Claims, 21 Drawing Figures

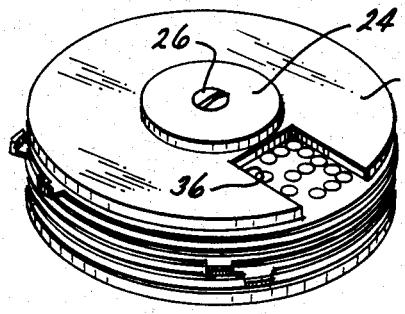
Fig. 1
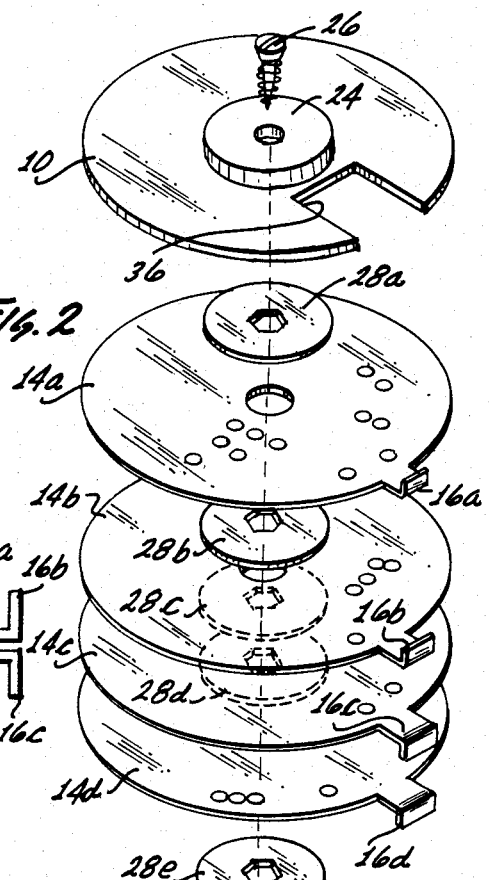
Fig. 2
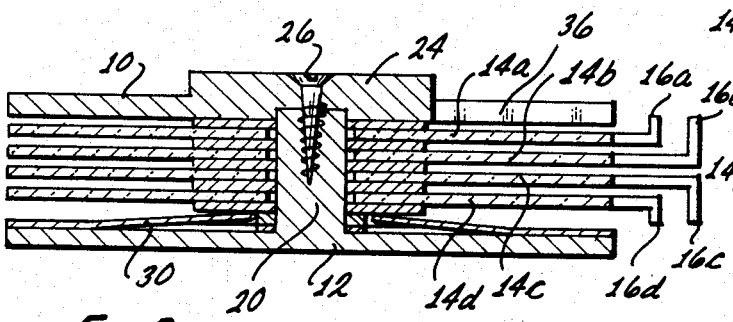
Fig. 3
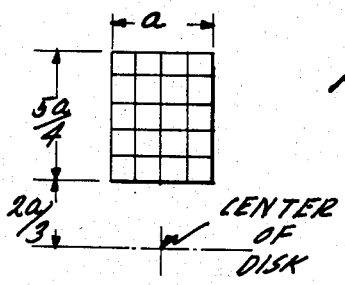
Fig. 4
Fig. 5
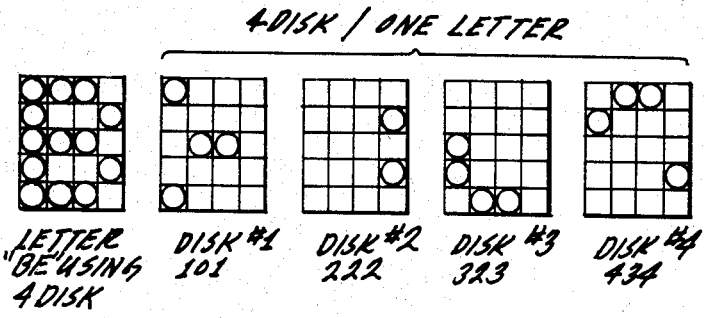

DISK USED
| | #1 | #2 | #3 | #4 |
|---|---|---|---|---|
| A | 105 | 216 | 332 | 435 |
| B | 101 | 222 | 323 | 434 |
| C | 112 | 221 | 323 | 434 |
| D | 103 | 222 | 323 | 434 |
| E | 101 | 215 | 324 | 437 |
| F | 101 | 221 | 324 | 437 |
| G | 104 | 221 | 323 | 434 |
| H | 101 | 217 | 324 | 445 |
| I | 106 | 213 | 330 | 439 |
| J | 106 | 221 | 330 | 436 |
| K | 110 | 216 | 324 | 440 |
| L | 111 | 219 | 323 | 443 |
| M | 108 | 217 | 325 | 438 |
| N | 108 | 217 | 333 | 438 |
| O | 108 | 222 | 323 | 434 |
| P | 101 | 221 | 324 | 442 |
| Q | 106 | 218 | 323 | 434 |
| R | 101 | 217 | 324 | 434 |
| S | 109 | 221 | 331 | 434 |
| T | 102 | 221 | 328 | 441 |
| U | 108 | 222 | 323 | 438 |
| V | 107 | 220 | 329 | 438 |
| W | 108 | 217 | 329 | 444 |
| X | 110 | 214 | 325 | 444 |
| Y | 102 | 222 | 328 | 441 |
| Z | 110 | 215 | 326 | 437 |
Fig. 6
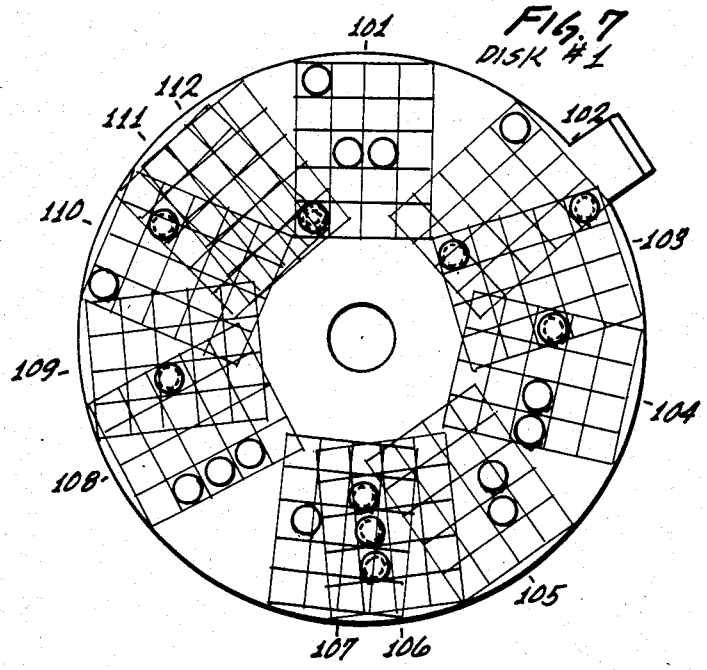
Fig. 7 DISK #1
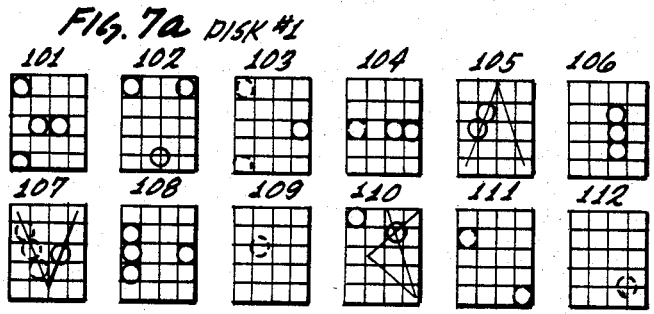
Fig. 7a DISK #1
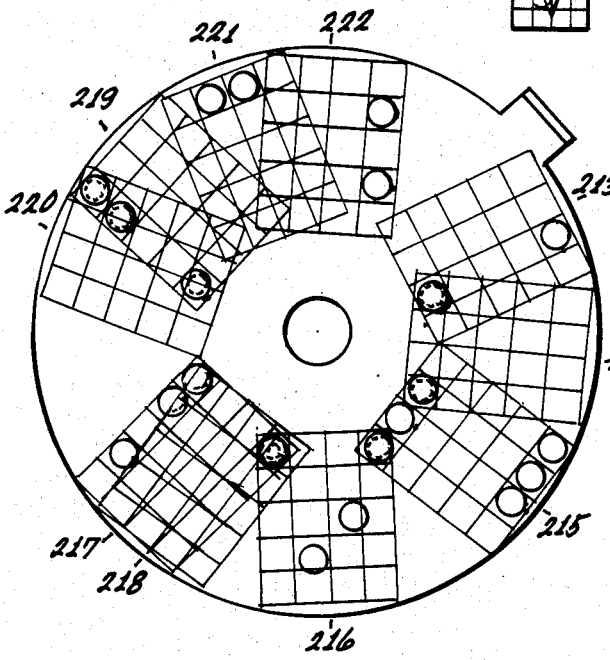
Fig. 8 DISK #2
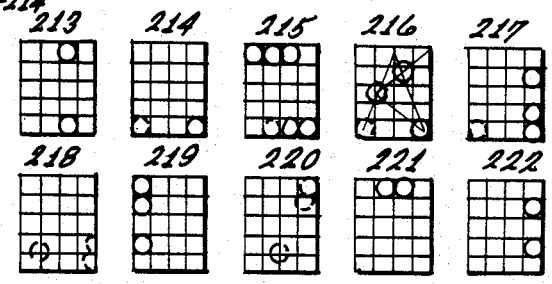
Fig. 8a DISK #2

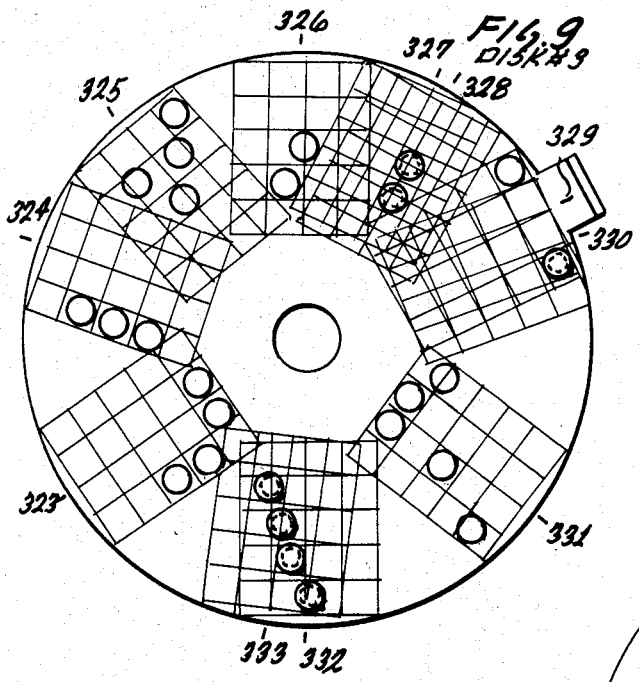
Fig. 9
DISK #3
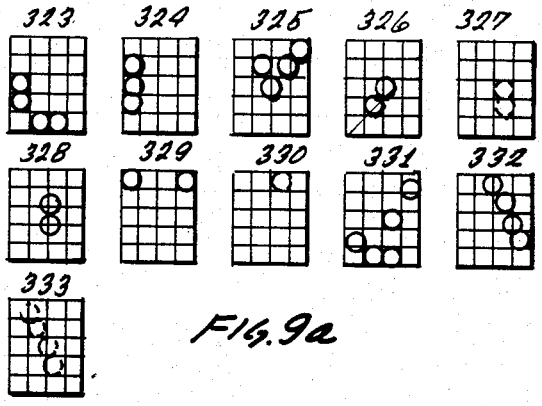
Fig. 9a
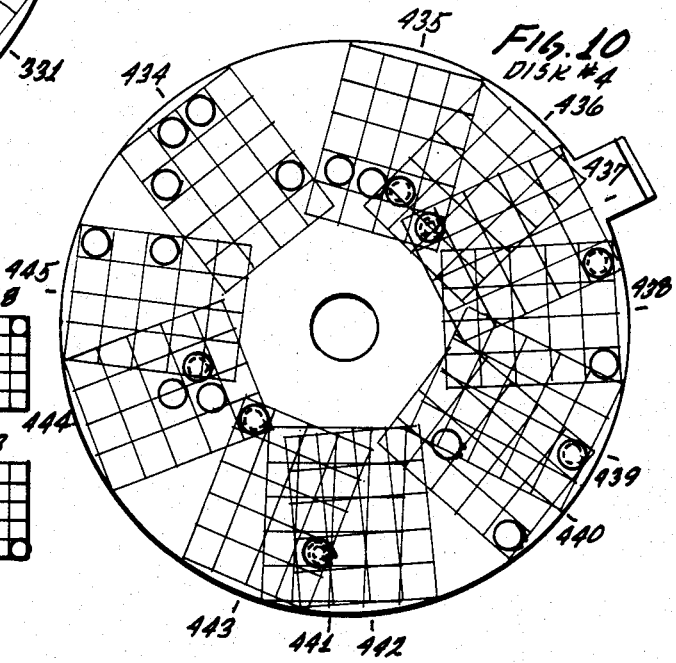
Fig. 10
DISK #4
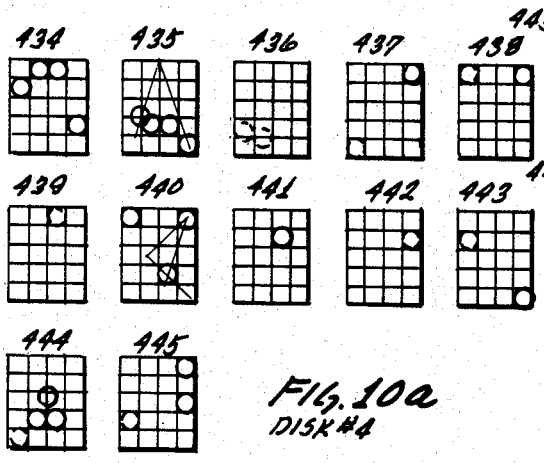
Fig. 10a
DISK #4
Fig. 11
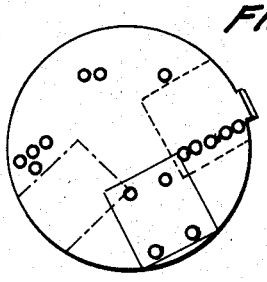
Fig. 11b
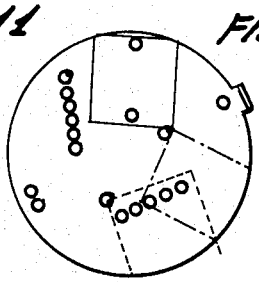
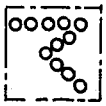
Fig. 12
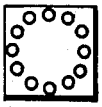
Fig. 12a
Fig. 11a
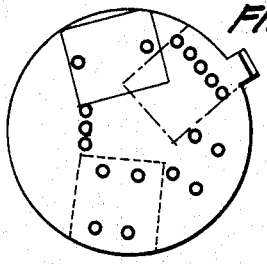
Fig. 11c
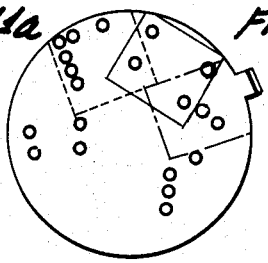
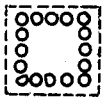
Fig. 12b

METHOD OF FORMING A DEVICE FOR VIEWING COMPOSITE DESIGNS

BACKGROUND OF THE INVENTION

1. Field of the Invention

The field of the invention is that of devices that may be characterized as educational devices, teaching devices, or play devices requiring a degree of skill.

2. Description of the Prior Art

With respect to prior art, reference is made to British Pat. No. 12,693; U.S. Pat. Nos. 3,183,793, 3,762,071 and 3,460,273. The prior art devices are in some instances referred to as an educational device or teaching aid or otherwise. The prior art devices utilize rotatable disks, but otherwise are lacking in characteristics and capabilities such that utilization of the device requires a particular combination of intelligence, skill, and capability. The herein invention is unique in these respects as will become apparent from the following detailed description of preferred embodiments of the invention.

SUMMARY OF THE INVENTION

In a preferred form of the invention it is constructed as a circular device having a plurality of rotatable transparent disks individually rotatable between top and bottom disk members. The disks are transparent and each has a pattern or group of opaque spots on it, the patterns being arranged around the center of each disk. The top disk or cover of the device has a cutout or window in it. The disks, for example, being four in number can be individually rotated to bring a group or pattern of opaque spots on each disk into alignment with the window so that the individual patterns on the four disks can all be seen through the window.

The patterns of spots on the disks are so arranged in a predetermined format and manner that in a preferred embodiment, patterns or groups of spots on the disks can be brought into visual alignment with the window in a manner that the spots collectively define, for example, a particular letter of the alphabet. Thus, to produce an individual letter, such as the letter B requires that the four disks must be rotated to a predetermined position in which the patterns of opaque spots on disks will collectively produce the letter. In a preferred form of the invention the spots on the disk are arranged to produce any of the letters of the alphabet. It is, of course, understood that the invention can be designed to produce other shapes, designs, images, or figures through the window in the top cover of the device such as geometric figures or otherwise. The "spots" can be any form of component parts of a design or image made of component parts.

Particular technology is provided whereby the positioning of the groups of opaque spots on the disks are predetermined and placed on the disks. Preferably this is accomplished by utilizing grids of squares and then separating the opaque spots that will produce a letter such as the letter B, into a group of component parts, such as four parts or groups of spots which are then placed in squares on individual grids. In this manner grids carrying groups of components of spots can be prepared for every letter in the alphabet and all of the grids for all of the respective disks can be individually identified by number. In this manner a table can be prepared in which each grid for each disk for producing all the individual letters of the alphabet in the window can be set up. In this manner using the prepared grids and table the groups of dots, that is, the components of the letters can readily be applied to the individual disks.

In the light of the foregoing, the primary object of the invention is to provide and make available an improved device or game embodying transparent disks carrying groups of opaque spots, the groups being component parts of desired letters, designs, or figures such that the disks can be rotated to positions wherein groups of spots on individual disks, can be brought into alignment with a window in the top of the device so as to display a particular letter, design, or geometric figure or otherwise.

A further object is to provide a device as in the foregoing, including a group of individually rotatable transparent disks, each bearing groups or patterns of opaque spots angularly spaced with a top cover disk having a window and bottom cover disk with extending figure members whereby each disk can be individually rotated.

Further objects and additional advantages of the invention will become apparent from the following detailed description and annexed drawings.

BRIEF DESCRIPTION OF THE DRAWINGS

FIG. 1 is an isometric view of a preferred form of the invention;

FIG. 2 is an exploded view of the parts of the invention of FIG. 1;

FIG. 3 is a cross sectional view of the device of the previous figures;

FIG. 4 is a schematic view of a rectangular diagram or grid which may be used in construction of the disks of the device;

FIG. 5 is an illustrative view of five patterns or grids one of which illustrates the letter B and which illustrates how opaque spots can be placed within squares of the patterns to form a letter;

FIG. 6 is a table including reference to four separate disks and letters of the alphabet illustrating the patterns utilized to form all of the letters;

FIG. 7 is an illustrative view showing how a disk is prepared with opaque spots on it;

FIG. 7*a* illustrates rectangular patterns nos. 101 through 112 for placing the opaque spots on disk no. 1;

FIG. 8 is an illustrative view like that of FIG. 7, but for disk number 2;

FIG. 8*a* is an illustrative view of the rectangular grids or patterns 213 through 222 for positioning the opaque spots on disk number 2;

FIG. 9 is an illuatrative view showing how the opaque spots are placed on disk no. 3;

FIG. 9*a* is an illustrative view of the group of 11 patterns nos. 323 through 333 illustrating how the spots are positioned on disk no. 3;

FIG. 10 is a view similar to that of FIGS. 7, 8, and 9 illustrating the patterns 434 through 445 for positioning the spots on disk no. 4;

FIG. 10*a* is an illustrative view of patterns 434 through 445 for desk no. 4;

FIGS. 11, 11*a*, 11*b*, and 11*c* are illustrative of four additional disks representing another embodiment of the device or game wherein instead of positioning spots for forming letters they are positioned to form geometric figures;

FIGS. 12, 12*a*, and 12*b* are illustrative views of patterns, that is, rectangular patterns having on them spots forming geometric figures of the type which are produced by the disks of FIGS. 11, 11*a*, 11*b*, and 11*c*.

DESCRIPTION OF A PREFERRED EMBODIMENT AND BEST MODE OF PRACTICE

FIGS. 1 through 10*a* illustrate in detail one preferred form of the invention. The physical form of the preferred embodiment is illustrated in FIGS. 1, 2, and 3. In these figures the toy or game embodies an upper disk 10 and a lower disk 12 that may be made of any suitable materials. As shown in the exploded view in between the disks 10 and 12 are transparent disks 14*a*, 14*b*, 14*c*, and 14*d*. Each of these disks has an extending figure or projections as designated at 16*a*, 16*b*, 16*c*, and 16*d* by which the disks can be individually rotated, manually.

The lower disk 12 has an extending hexagonal stem 20 which extends through all of the transparent disks as may be seen in FIG. 3. The top disk 10 has a central circular enlargement 24 through which a screw 26 extends and which extends into the stems 20.

Positioned on opposite sides of the rotatable transparent disks 14 are washers as designated at 28*a*, 28*b*, 28*c*, 28*d*, and 28*e*, which have hexagonal openings which fit over the stem 20 so that they are not rotatable and which provide for rotating individual disks without rotating the other disks.

Positioned over the bottom disk 12 is another disk 30 having cutouts providing upwardly extending flaps as shown at 32*a*, 32*b*, 32*c*, and 32*d*. This disk and the flaps are made of suitable material so as to exert a bias against the disks and the washers so as to urge them against the bottom of the upper disk 10. Numeral 34 designates a small washer on the stem 20, which is above the disk 30. The top disk 10 has a rectangular cutout 36 in it as shown.

At the outset and as will be explained shortly the transparent disks have opaque spots on them and the disks can be rotated manually to bring patterns of spots into view in the cutout 36 in the top disk or plate 10. In the preferred form of the invention the position of the opaque spots is illustrated in FIGS. 7, 8, 9, and 10. These figures illustrate the actual position of the spots whereby the disks can be rotated manually to bring patterns of spots into view in the cutout 36 so as to form letters visible through the cutout as will be explained. All letters of the alphabet can be formed.

FIGS. 4 through 10*a* illustrate the manner in which letters are formed and also the manner in which the patterns or groups of spots are formed on the individual disks. FIG. 4 is a view of a rectangular grid having 20 squares in it to illustrate how letters are formed as will be described. The size illustrated in FIG. 4 is typical of the embodiment being described.

FIG. 5 illustrates how grids like that of FIG. 4 are utilized to form letters of the alphabet. FIG. 5 illustrates the formation of the letter B by way of spots on the disks which would appear in the cutout 36. FIG. 5 illustrates four of the grids showing how the spots of the letter are divided into components or groups illustrating how the B would be produced in the cutout 36. Each of the grids is numbered as illustrated in FIG. 5, the numbers being 101, 222, 323, and 434.

A group of grids is prepared for each of the disks 1, 2, 3, and 4, as illustrated in FIGS. 7*a*, 8*a*, 9*a*, and 10*a*. Each of these contains a pattern or group of spots so that when the appropriate area of each of the individual four disks is brought into alignment with the cutout 36 in the top member 10 a letter of the alphabet can be formed. As will be seen in the figures mentioned each of the grids with pattern of spots is identified by an individual number.

FIG. 6 is a table listing all the letters of the alphabet and the grid number under the number of each of the four disks that identifies the grid pattern that must appear in the cutout 36 to form an individual letter.

As previously stated, FIGS. 7, 8, 9, and 10 show the actual position of the opaque spots on each of the disks by which all of the letters of the alphabet can be made to appear in the cutout or window 36 of the device of FIG. 1. The groups of spots are components of the letters. The spots could, of course, be components of other things such as geometric figures, pictorial designs, etc., and could be simply parts rather than actual spots.

FIGS. 7, 8, 9, and 10 illustrate a method or manner of actually applying the spots to individual disks after preparing the grids for the individual disks as shown in FIGS. 7*a*, 8*a*, 9*a*, and 10*a*. FIG. 7 illustrates the grids for the patterns of spots, that would be placed on disk number 1. FIG. 8 illustrates the grids or patterns for the spots that are placed on disk number 2. FIG. 9 illustrates the grids or patterns for the spots that are placed on disk number 3 and FIG. 10 illustrates the grids or patterns for the spots that are placed on disk 4. As will be seen each grid or pattern of spots is identified by its number in FIGS. 7, 8, 9, and 10. In these figures the grids are shown superimposed over their respective components or groups of spots.

A preferred technique for applying the spots is as follows. The disk such as disk number 1 can be placed under a plate like the plate 10 having the window in it. Then in the window the spots of the grid 101 are applied to the disk as may be seen in FIG. 7. They may be applied in any convenient way, such as sticking on opaque pieces. This pattern is then moved out of the window by rotating the disk to the next position where the pattern of spots of the grid 102 can be applied.

FIG. 7 illustrates all of spots in groups identified by their respective grids as shown in FIG. 7*a*. In some instances the spots in one grid or grid pattern are used in an adjacent grid pattern as well as illustrated in FIG. 7 by the grids 102 and 103 and other adjacent grids, the spots that are used for more than one pattern being idenified by way of a broken circle.

In accordance with the foregoing technique utilizing the individual numbered grid patterns the spots can be placed on the individual disks 2, 3, and 4 in a similar manner.

As previously stated the position of the spots as shown in FIGS. 7, 8, 9, and 10 are the actual positions for forming all letters of the alphabet with the four disks as identified in the table of FIG. 6.

From the foregoing those skilled in the art will readily understand the operation and utilization of the game or device. The utilization is readily illustrated by FIG. 1 which shows how the letter B would be formed or cause to appear in the window 36. Each disk can be individually manipulated by the finger members 16*a*, 16*b*, 16*c*, and 16*d*. To form the letter B the user would have to rotate individual disks until the following occurs. The grid or pattern 101 on the disk would appear in the window 36; the grid or pattern 222 of disk 2 would be aligned with the window; the grid or pattern 323 of disk number 3 would be aligned with the window, and the grid or pattern 434 of disk number 4 would be aligned with the window. The letter B would then be seen in the window. Thus, in this manner any desired letters can be formed. It is readily to be seen that the device has very considerable entainment value involved in the process of the user rotating the disk to produce a desired letter in the window 36. It can be seen also that skill can be developed in manipulating the disks in order to bring the necessary patterns into view in the window 36 to produce a desired letter.

It is to be understood that the invention is, of course, not limited to produce letters of the alphabet in the window but rather using the technique as described patterns can be provided on the disks for producing other desired letters or geometric figures or otherwise, such as pictorial figures or designs, the groups of spots being the components which when brought together produce the desired letter, design, or image.

The device may be constructed to display, for example, geometric figures in the window 36. Illustratively there might be, for example, 15 geometric figures made up of spots in the manner that the letter B is made in FIG. 5. FIGS. 12, 12*a*, and 12*b*, by way of example, show three of such geometric figures one of which is a design of spots in FIG. 12, a circle of spots in FIG. 12*a*, and a square made of spots made in FIG. 12*b*.

FIGS. 11, 11*a*, 11*b*, and 11*c* illustrate four disks as in the previous embodiment, the disks having opaque spots on them, the spots occupying the actual positions that they would have whereby upon appropriate rotation of the disks any one of the geometric figures, three of which are illustrated in FIGS. 12, 12*a*, and 12*b* can be caused to appear in the window 36.

The outline in FIG. 12 is in dot-dash lines; the outline in FIG. 12*a* in full line; and the outline in FIG. 12*b* is in broken lines. Squares containing spots included in the geometric figures of FIGS. 12–12*b*, are shown on the four disks, FIGS. 11, 11*a*, 11*b*, and 11*c*. The squares in dot-dash lines in FIGS. 11–11*c* illustrate the positioning of spots on the disks for forming the design of FIG. 12. The squares in full lines on the disks 11–11*c* illustrate the positioning of the spots on the respective disks for producing the design of FIG. 12*a*. The squares in broken lines on the respective disks 11–11*c* illustrate the positioning of spots for producing the design of FIG. 12*b*. In a similar manner all of the geometric designs, for example, 15 can be broken down into components on grids like those of FIG. 5 illustrating patterns to be applied to respective disks, FIGS. 11–11*c* illustrating th manner of positioning the patterns of spots on the respective disks.

From the foregoing those skilled in the art will readily understand the nature of the invention, the manner of its construction and utilization.

The foregoing disclosure is representative of preferred forms of the invention and is to be interpreted in an illustrative rather than a limiting sense, the invention to be accorded the full scope of the claims appended hereto.

I claim:

1. A method of forming a game device which comprises a plurality of transparent disks, each of which having areas of spots such that a plurality of composite designs are viewed through a window, comprising the steps of:

forming said plurality of transparent disks to be rotatable about a common axis;

forming a top member over said plurality of transparent disks, said top member having said window in it through which a section of each of said plurality of transparent disks underneath said window can be viewed;

preparing said plurality of composite designs to be placed on said plurality of transparent disks to be viewed through said window, comprising the steps of, separating each of said plurality of composite designs into component parts, said component parts in superimposed relationship producing one of said plurality of composite designs, preparing rectangular grids, disposing on each grid one of said plurality of component parts, each of said component parts being in the form of one or more opaque spots, providing a portion of said rectangular grids for each of said plurality of transparent disks, and arranging said rectangular grids in angularly spaced relationship on corresponding separate or overlapping areas on said plurality of transparent disks to be rotated to bring into aligned relationship a portion of said plurality of component parts which can be collectively seen through said window, collectively producing any one of the said plurality of composite designs.

2. The preparing step of claim 1 further comprising the steps of, numbering each of said rectangular grids, and forming a tabulation which identifies each of said rectangular grids, said tabulation identifying the particular rectangular grid of each of said plurality of transparent disks that will produce each of said plurality of composite designs.

* * * * *